US007370561B2

(12) United States Patent
Mikiya et al.

(10) Patent No.: US 7,370,561 B2
(45) Date of Patent: May 13, 2008

(54) ELECTRIC DRIVER

(75) Inventors: Toshio Mikiya, Tokyo (JP); Takayuki Okamoto, Tokyo (JP); Tameyoshi Oshima, Tokyo (JP); Yasuo Kazama, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 10/545,178

(22) PCT Filed: Aug. 9, 2004

(86) PCT No.: PCT/JP2004/011441

§ 371 (c)(1),
(2), (4) Date: Aug. 9, 2005

(87) PCT Pub. No.: WO2005/014234

PCT Pub. Date: Feb. 17, 2005

(65) Prior Publication Data

US 2006/0185481 A1 Aug. 24, 2006

(30) Foreign Application Priority Data

Aug. 12, 2003 (JP) ..... 2003-292413

(51) Int. Cl.
*B25B 23/157* (2006.01)

(52) U.S. Cl. ..... 81/474; 81/476

(58) Field of Classification Search ..... 81/474, 81/476, 479

See application file for complete search history.

(56) References Cited

U.S. PATENT DOCUMENTS

| | | | | | |
|---|---|---|---|---|---|
| 2,963,134 | A | * | 12/1960 | Banner | 192/56.32 |
| 3,596,542 | A | * | 8/1971 | Wallace | 81/474 |
| 3,613,751 | A | * | 10/1971 | Juhasz | 81/474 |
| 3,616,883 | A | * | 11/1971 | Sindelar | 192/56.61 |
| 4,774,864 | A | * | 10/1988 | Dossier | 81/474 |
| 4,836,349 | A | * | 6/1989 | Sakamoto et al. | 192/56.33 |

FOREIGN PATENT DOCUMENTS

| | | | |
|---|---|---|---|
| JP | 58-93474 | * | 6/1983 |
| JP | S58-093474 U | | 6/1983 |
| JP | S58-143173 U | | 9/1983 |
| JP | S59-054828 A | | 3/1984 |
| JP | S59-054828 A | * | 3/1984 |
| JP | 60-90676 | * | 5/1985 |
| JP | S60-090676 A | | 5/1985 |
| JP | 60-80872 | * | 6/1985 |
| JP | S60-080872 U | | 6/1985 |
| JP | 33998/1988 | | 3/1988 |
| JP | H01-138673 | * | 9/1989 |
| JP | H01-138673 U | | 9/1989 |

* cited by examiner

*Primary Examiner*—Joseph J. Hail, III
*Assistant Examiner*—Bryan R Muller
(74) *Attorney, Agent, or Firm*—Brinks Hofer Gilson & Lione

(57) ABSTRACT

A power screwdriver (10) includes a bit holder (14) bored to receive the shaft of a screwdriver bit (12) and adapted to securely hold the screwdriver bit (12) in place, and a housing (18) having a through cavity (16). The bit holder (14) is inserted into the through cavity (16) so that the bit holder (14) is rotatable about and movable along the axis of the bit holder. This arrangement securely holds the screwdriver bit and thus, minimize rattling of the screwdriver bit during rotation.

8 Claims, 2 Drawing Sheets

ELECTRIC DRIVER

FIELD OF THE INVENTION

The present invention relates to power driven screwdrivers.

BACKGROUND OF THE INVENTION

A power screwdriver typically includes a driving motor, a screwdriver bit drivingly rotated by the driving motor, and a transmission system interposed between the motor and the screwdriver bit to transmit rotational torque to the screwdriver bit.

The transmission system is provided with clutch means for interrupting torque transmission when a predetermined torque load is exerted on the screwdriver bit. The clutch means includes an annular cam formed on its one side with a cam path, a plurality of clutch balls held in contact with the cam path, a compression spring disposed along the axis of the screwdriver bit to urge the clutch balls against the cam, and an adjusting member for adjusting the compressive force of the compression spring. With this arrangement, the cam and the clutch balls are engaged with one another to allow torque to be transmitted through the transmission system until a predetermined torque is applied between the cam and the clutch balls. When the applied torque exceeds such a predetermined torque, the clutch balls are rotated relative to the cam so that no rotational torque is transmitted through the transmission system.

The transmission system is contained within a cylindrical housing. The adjusting member is in the form of a cup and includes a cylindrical wall and an end wall connected to the front end of the cylindrical wall. A female thread is formed on the inner surface of the cylindrical wall. A male thread is formed on the outer surface of the housing and threadingly engaged with the female thread. Threaded adjustment of the adjusting member serves to regulate the compressive force of the compression spring which is held in contact with the end wall of the adjusting member. The front end of the transmission system acts as a bit holder or chuck for holding the screwdriver bit. The end wall of the adjusting member has an opening through which the bit holder forwardly projects from the adjusting member. Such a conventional power screwdriver is disclosed in Japanese patent application publication No. 61-270080.

DISCLOSURE OF THE INVENTION

The power screwdriver as thus far described suffers from the following defects.

Firstly, the compression spring and its associated elements are arranged between the housing and the transmission system. This arrangement makes it difficult to firmly hold the front end of the transmission system in place in the housing. The screwdriver bit, which extends forwardly from the transmission system, is thus subject to vibrations during rotation. If such undesirable vibrations occur, secure tightening and loosening of screws may not be effected.

Secondly, the bit holder has a plurality of openings through which a plurality of corresponding ball detents (or locking balls) are placed. The shank of the screwdriver bit has a locking recess. When the shank of the screwdriver bit is inserted into the cylindrical bit holder, the ball detents are lockingly received in the locking recess so as to lock the screwdriver bit in place in the bit holder. A slight play is, however, likely to be present between the ball detents and the locking recess. This results in rattling of the screwdriver bit.

Thirdly, when a predetermined torque is reached, the clutch balls are forced to ride over the raised lands of the cam so that no rotational torque is transmitted to the screwdriver bit. The clutch balls are then urged back to its initial position under the bias of the compression spring. Such a sudden return may cause damage, for example, to a limit switch (which is rendered operative to switch off the motor when the clutch balls ride over the raised lands of the cam).

SUMMARY OF THE INVENTION

It is an object of the present invention to eliminate the foregoing defects.

According to the present invention, there is provided a power screwdriver which includes a bit holder for receiving the shank of a screwdriver bit to securely hold the screwdriver bit, a housing including a through cavity defined to receive the bit holder so that the bit holder is rotatable about its own axis and axially slidable within the through cavity, a cam axially spaced from the proximal end of the bit holder and including a cam surface extending in a direction perpendicular to the axis of the bit holder, oriented toward the proximal end of the housing and defining a circular cam path in a coaxial relation to the bit holder, a drive shaft connected to the cam to cause the cam to rotate about the axis of the bit holder, a clutch element disposed between the bit holder and the cam and engaged with the circular cam path, an annular bore defined to be open to the distal end of the housing and axially extending from the distal end toward the proximal end of the housing, a compression spring disposed within the annular bore, a thrust member engaged with the compression spring, extending out of the housing through the proximal end of the housing and adapted to transmit the compressive force of the compression spring to the clutch element and urge the clutch element against the cam surface, and a compressive force regulating member releasably mounted to the distal end of the housing, engaged with one end of the compression spring and axially displaced to regulate the compressive force of the compression spring, wherein the cam path includes a raised land axially projecting from the cam surface toward the proximal end of the bit holder, wherein the clutch element is engaged with the raised land to thereby transmit rotational torque to the bit holder when the cam is caused to rotate, and wherein the clutch element is forced to ride over the raised land so as to release the rotational torque when a predetermined torque load is reached.

In the power screwdriver, the housing is capable of directly and securely holding the bit holder in place since the bit holder is received in the through cavity of the housing. This arrangement thus minimizes vibrations of the screwdriver bit which may occur during rotation of the screwdriver bit.

In a preferred embodiment, a radial bearing assembly is disposed adjacent to the distal end of the through cavity of the housing. This assembly aids to securely hold the screwdriver bit and thus, reduces possible vibrations of the screwdriver bit.

In one embodiment, the power screwdriver includes a clutch element retainer secured to the proximal end of the bit holder and axially spaced from the cam surface toward the bit holder. The clutch element is in the form of a ball, a roller or similar element rotatably carried by the clutch element retainer and held in contact with the cam path.

In another embodiment, the power screwdriver includes an axially movable follower interposed between the clutch element retainer and the proximal end of the housing and held in engagement with the thrust member, and a thrust bearing arranged between the follower and the clutch element retainer. The thrust member is operable to urge the clutch element against the cam surface via the thrust bearing and the follower.

In one embodiment, the compressive force regulating member includes a cylindrical wall disposed coaxially of the bit holder and an end wall connected to one end of the cylindrical wall. The compressive force regulating member has a cup shape and is open to the distal end of the housing. A female thread is formed on the inner surface of the cylindrical wall. A male thread is formed on the outer surface of the housing adjacent to its distal end and engaged with the female thread. The compression spring has one end engaged with the inner surface of the end wall of the compressive force regulating member.

In one embodiment, the power screwdriver includes an annular element slidably disposed on the inner surface of the end wall of the compressive force regulating member, a retaining rod extending from the annular element in parallel relation to the axis of the bit holder. The housing includes a hole extending from the distal end toward the proximal end of the housing. The retaining rod is slidably disposed in the hole of the housing, but rotationally secured to the housing. The end of the compression spring is engaged with the end wall through the annular element.

In one embodiment, the power screwdriver includes a front ramp and a rear ramp located rearwardly from the front ramp when the bit holder is rotated in a working direction. The front ramp has a relatively steep pitch, and the rear ramp has a relatively gentle pitch. The power screwdriver also may include a one-way clutch operable to transmit rotational torque from the drive shaft to the bit holder only when the bit holder is rotated in a direction opposite the working direction. The screwdriver bit is rotated in a working direction to drive a screw until a predetermined toque is reached. In this mode of operation, the clutch element is engaged with the front ramp so as to transmit rotational torque from the driving motor to the screwdriver bit through the cam, the clutch element, the clutch element retainer and the bit holder. When the applied torque exceeds a preset value, the clutch element is forced to ride over the raised land so that no rotational torque is transmitted to the screwdriver bit. The clutch element is thereafter returned to its initial position. At this time, the clutch element travels over the gently inclined rear ramp rather than the steeply inclined front ramp. This arrangement thus avoids any damages to adjacent elements.

In another embodiment, the bit holder includes a through bore extending between the distal and proximal ends of the bit holder. The shank of the screwdriver bit is inserted into the through bore through the distal end of the bit holder. The bit holder includes a locking element engaged with the shank and the bit holder to lock the screwdriver bit against axial and rotational movements. The drive shaft is loosely inserted into the through bore through the proximal end of the bit holder. A second compression spring is disposed between the shank of the screwdriver bit and the drive shaft to urge the screwdriver bit in a forward direction. This feature ensures that the screwdriver bit is carried by the bit holder without rattling.

PREFERRED EMBODIMENTS

The present invention will now be described with reference to the accompanying drawings.

Figure 1:
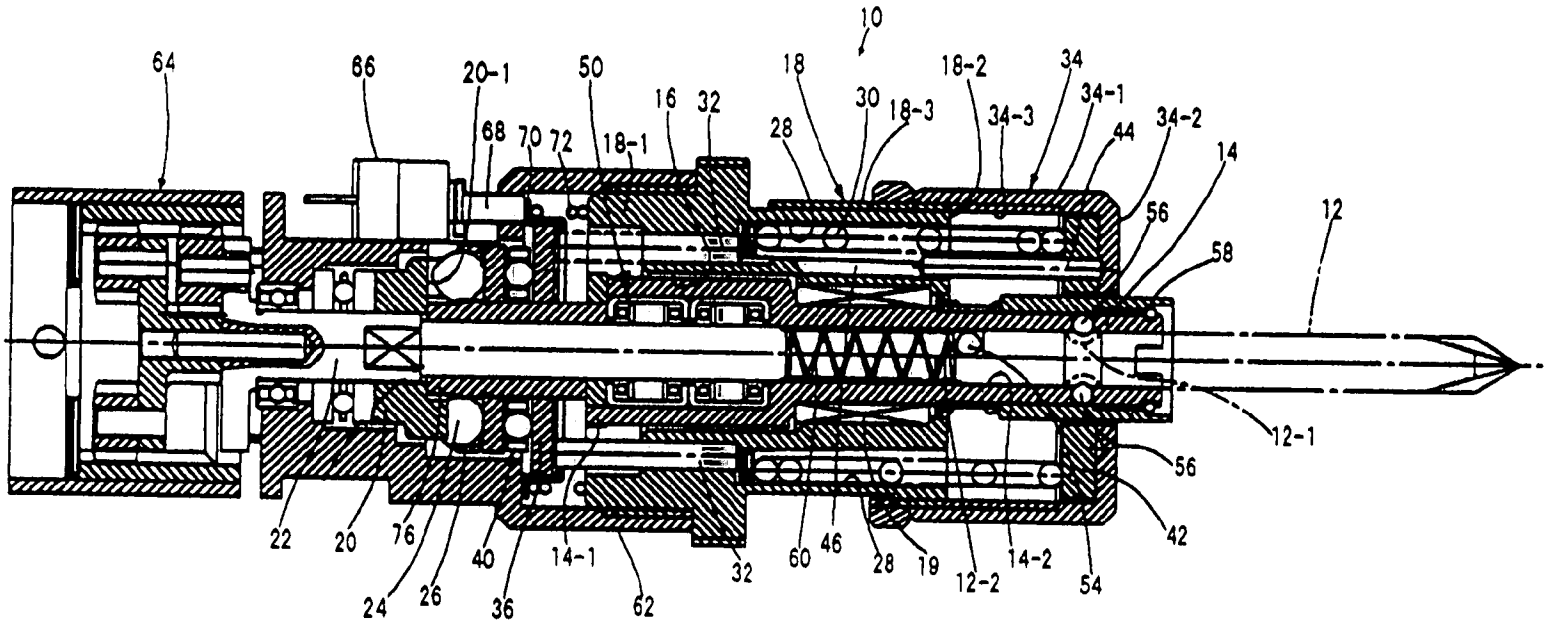
FIG. 1 is a longitudinal cross sectional view showing the principal portion of a power screwdriver according to the present invention.

FIG. 1 is a longitudinal section of a power screwdriver 10 assembled according to the present invention.

As shown, the power screwdriver 10 includes a cylindrical bit holder 14 having a distal end (right end in the drawings) through which the shank of a screwdriver bit 12 is inserted into and firmly held in the bit holder 14, a cylindrical housing 18 including a through cavity 16 defined to receive the bit holder 14 so that the bit holder 14 is rotatable about its own axis and axially slidable within the through cavity 16, an annular cam 20 (see FIG. 2) axially spaced a predetermined distance from a proximal end (left end in the drawings) 14-1 of the bit holder 14 and including a cam surface 20-1 which extends in a direction perpendicular to the axis of the bit holder, is oriented in a face-to-face relation to the proximal end 14-1 of the bit holder 14, and defining a circular cam path coaxial with the bit holder 14, a drive shaft 22 connected to the cam 20 and driven by a driving motor (not shown) to cause the cam 20 to rotate about the axis of the bit holder, a plurality of clutch elements (illustratively, in the form of balls or rollers 24) disposed between the bit holder 14 and the cam 20 and engaged with the circular cam path of the cam surface 20-1 of the cam, an annular clutch element retainer 26 configured to rotatably supports the clutch elements 24, an annular bore 28 defined to be open to a distal end 18-2 of the housing 18 and extending from the distal end 18-2 toward a proximal end 18-1 of the housing 18, a compression spring 30 inserted into the annular bore 28, a plurality of elongated thrust rods or members 32 engaged with the compression spring 30, projecting out of the proximal end 18-1 of the housing 18, and adapted to transmit a compressive force from the compression spring 30 to the clutch elements 24 and urge the clutch elements 24 against the cam surface 20-1, and a cup-shaped compressive force regulating member 34 releasably mounted over the distal end 18-2 of the housing, engaged with one end of the compression spring 30, and axially displaceable to regulate the compressive force of the compression spring 30.

The bit holder 14 is securely held within the through cavity 16 of the housing 18 for rotation about its own axis. In the illustrated embodiment, a radial or needle bearing assembly 19 is arranged adjacent to the distal end of the through cavity 16.

Figure 2:
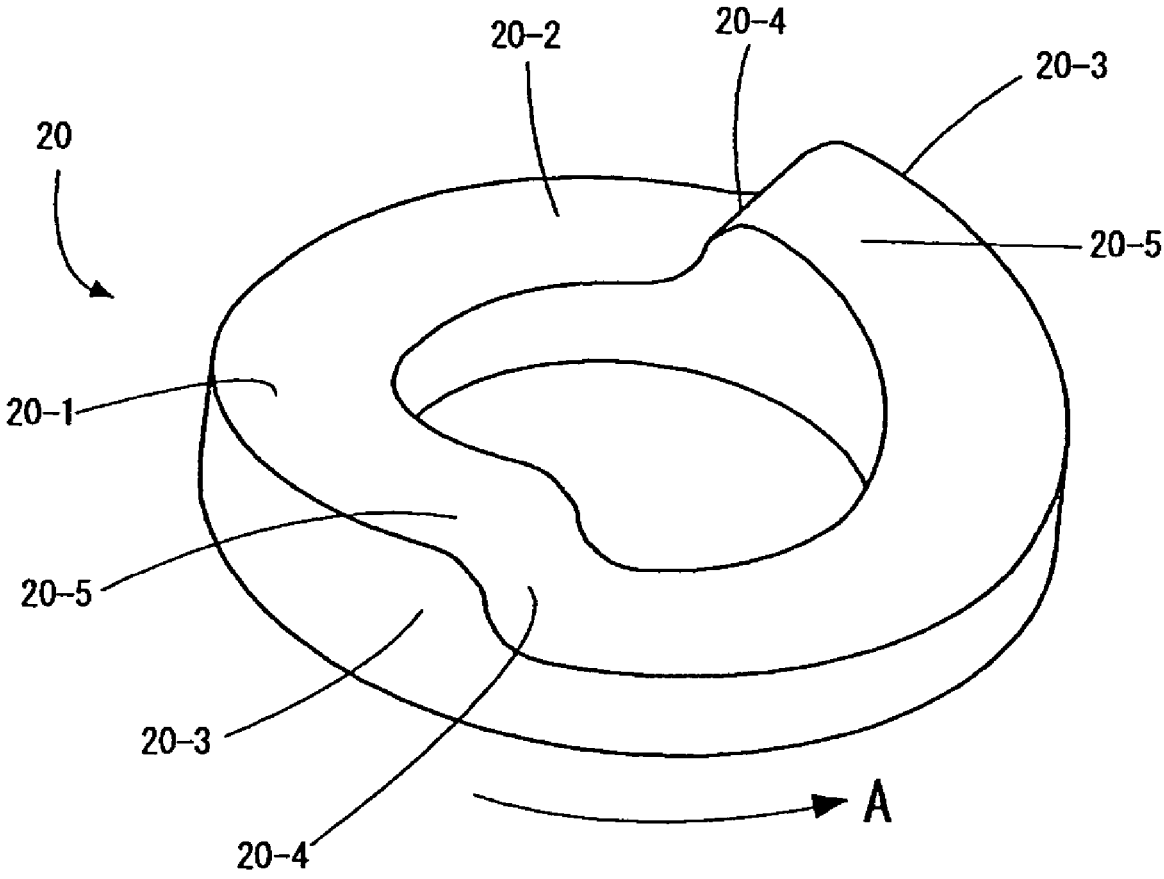
FIG. 2 is a perspective view of a cam used in the power screwdriver.

Referring to FIG. 2, the cam path 20-2 includes opposite raised lands 20-3, 20-3. The raised lands 20-3, 20-3 project from the cam surface 20-1 toward the proximal end 14-1 of the bit holder 14. The clutch elements 24 are engaged with the respective raised lands 20-3, 20-3 so as to transmit rotational torque from the cam 20 to the bit holder 14 during rotation of the cam 20. When the rotational torque exceeds a predetermined level, the clutch elements 24 are forced to ride over the adjacent raised lands 20-3, 20-3.

An annular follower 36 is situated between the clutch element retainer 26 and the proximal end of the housing 18 and is movable along the axis of the bit holder. The follower 36 is engaged with one end of each of the thrust members 32 which extends from the proximal end of the housing 18. A thrust bearing 40 is arranged between the follower 36 and the clutch element retainer 26. The thrust members 32 serve to transmit a compressive force from the compression spring 30 through the follower 36 and the thrust bearing 40 to the clutch elements 24 and urge the clutch elements 24 against the cam surface 20-1.

The compressive force regulating member 34 is fitted over the distal end 18-2 of the housing 18. The compressive force regulating member 34 has a cylindrical wall 34-1 extending around the axis of the bit holder and an end wall 34-2 connected to one end of the cylindrical wall 34-1. The compressive force regulating member 34 has a cup shape and is open at its one end to the distal end of the housing 18. A female thread 34-3 is formed on the inner surface of the cylindrical wall 34-1. A corresponding male thread 18-3 is formed on the outer surface of the distal end of the housing 18 and threadingly engaged with the female thread 34-1. An annular element 42 is coaxially held against the inner surface of the end wall 34-2 of the compressive force regulating member 34. The annular element 42 is slidably moved on the inner surface of the end wall 34-2. The annular element 42 is engaged with one end of the compression spring 30.

The annular element 42 is provided with elongated retaining rods 44. The retaining rods 44 extend parallel to the axis of the bit holder. The housing 18 has holes 46 to slidably receive the retaining rods. The holes 46 extend from the distal end toward the proximal end of the housing 18. The retaining rods 44 rotationally secure the annular element 43 to the housing 18.

Each of the raised lands 20-3, 20-3 of the cam 20 has a front ramp 20-4 of steep pitch and a rear ramp 20-5 of gentle pitch. The term "front" is used to mean one face which is located forwardly of the other face of the raised land as viewed when the cam is rotated in a working direction, as shown by the arrow A in FIG. 2. In FIG. 1, reference numeral 50 denotes a one-way clutch which serves to transmit a driving force from the drive shaft 22 to the bit holder 14 only when the cam 20 is rotated in a direction opposite the direction shown by the arrow A in FIG. 2.

The bit holder 14 has a through bore 14-2. The shank of the screwdriver bit 12 is inserted into the through bore 14-2 through the distal end of the bit holder 14. The bit holder 14 has a plurality of radial openings. The screwdriver bit 12 includes a circumferential recess 12-1. A plurality of locking elements or balls 56 are received in the respective radial openings of the bit holder 14 and engaged with the circumferential recess 12-1 of the screwdriver bit 12. This arrangement locks the screwdriver bit 12 against axial movement relative to the bit holder 14. The screwdriver bit 12 is formed at its proximal end with a step 12-2. A pin 54 is located within the through bore 14-2 of the bit holder 14 and extends in a direction transverse to the axis of the bit holder 14. The pin 54 is engaged with the step 12-2. This engagement prevents relative rotation of the screwdriver bit 12 and the bit holder 14. Reference numeral 58 denotes a sleeve fitted around the screwdriver bit 12 and axially slidably moved between two different positions. In one of the two positions shown in FIG. 1, the sleeve 58 exerts a radially inward force on the locking elements 56. In the other position, the sleeve 58 releases such a force from the locking elements 56.

The drive shaft 22 is inserted into and loosely fitted within the proximal end of the through bore 14-2 of the bit holder 14. Also, the shank of the screwdriver bit 12 is inserted into the distal end of the through bore 14-2. A compression spring 60 is interposed between the drive shaft 22 and the screwdriver bit 12 so as to constantly urge the screwdriver bit 12 in a forward direction. The compression spring 60 ensures that the screwdriver bit 12 is secured to the bit holder 14 through the locking elements 56 without a play.

A housing extension 62 is connected to the proximal end of the housing 18 and receives, among others, the thrust bearing 40, the cam 20 and the clutch elements 24. A reduction gear train 64 is arranged adjacent to the proximal end of the housing extension 62 so as to provide a reduction in the speed of rotation of a motor (not shown).

The limit switch 66 is mounted on the housing extension 62 and includes a switch actuator 68 in the form of a rivet. The switch actuator 68 is engaged with a flanged ring 70 which is, in turn, fitted around the follower 36. A coil spring 72 is disposed between the proximal end of the housing 18 and the ring 70 so as to urge the ring 70 against the switch actuator 68.

When the motor is started to rotate the screwdriver bit in a working direction, a threaded fastener or screw is rotationally driven to a workpiece. The screwdriver bit encounters an increased resistance to rotation as the threaded fastener is moved to a greater depth. When the applied torque exceeds a preset value, the clutch elements 24 are forced to travel over the raised lands 20-3 of the cam 20. This causes the clutch elements 24 and the switch actuator 68 to be moved toward the front end of the power screwdriver. As a result, the limit switch 66 is operable to switch off the motor. The clutch elements 24 and the switch actuator 68 are thereafter returned under the bias of the compression spring 30. Advantageously, the gentle pitch of the rear ramp 20-5 of the cam 20 avoids any damage to the switch actuator 68 and the limit switch 66.

Reference numeral 76 denotes a sleeve secured to the proximal end of the housing 18. The clutch element retainer 26, the thrust bearing 40, the follower 36 are held on the sleeve 76. The drive shaft 22 is loosely inserted into the sleeve 76. The clutch element retainer 26 The clutch element retainer 26 is secured to the sleeve 76, while the thrust bearing 40 and the follower 36 are rotatably mounted on the sleeve 76

The invention claimed is:

1. A power screwdriver comprising:

a bit holder (14) having a distal end, a proximal end and an axis, said bit holder being adapted to receive a bit shank of a screwdriver bit (12) to hold the screwdriver bit (12) in place;

a housing (18) having a distal end, a proximal end and an exterior, said housing including a through cavity (16) axially extending from said distal end to said proximal end of said housing and shaped to receive said bit holder so that said bit holder is rotatable about said axis and axially slidable within said through cavity, and an annular bore (28) defined between said through cavity (16) and said exterior of said housing, said annular bore being open to said distal end of said housing and extending from said distal end toward said proximal end of said housing;

a cam (20) axially spaced from said proximal end of said bit holder (14) and including a cam surface (20-1) extending at right angles to said axis and oriented toward said proximal end of said housing, said cam surface having a circular cam path extending about said axis;

a drive shaft (22) connected to said cam to cause said cam to rotate about said axis;

a clutch element (24) disposed between said bit holder and said cam and engaged with said circular cam path;

a compression spring (30) disposed within said annular bore and providing a compressive force;

a thrust member (32) engaged with said compression spring (30) and extending out of said housing (18) through said proximal end of said housing, said thrust member being operable to transmit said compressive force to said clutch element (24) and urge said clutch element against said cam surface (20-1); and a compressive force regulating member (34) releasably mounted to said distal end of said housing (18) and engaged with one end of said compression spring (30), said compressive force regulating member being axially displaced to regulate said compressive force of said compression spring, wherein said compressive force regulating member has a cup shape and includes a cylindrical wall (34-1) disposed coaxially of said bit holder (14) and having one end and an other end that is open to said distal end of said housing, and an end wall (34-2) connected to said one end of said cylindrical wall (34-1) and having an inner surface, said cylindrical wall (34-1) having an inner surface on which a female thread (34-3) is present, said exterior of said housing adjacent to said distal end having a male thread (18-3) engaged with said female thread, said compression spring (30) having one end engaged with said inner surface of said end wall of said compressive force regulating member;

an annular element (42) being in slidable direct contact with said inner surface of said end wall (34-2) of said compressive force regulating member (34); and, a retaining rod (44) extending in parallel relation to said axis of said bit holder (14) and having one end which is secured to said annular element (42), wherein said housing includes a hole (46) in said housing between said annular bore (28) and said through cavity (16) from said distal end of said housing (18) toward said proximal end of said housing; said retaining rod (44) is held axially slidably in said hole (46) of said housing against rotation around said axis; and, said one end of said compression spring is pressed against said annular element, wherein rotation of said compressive force regulating member (34) relative to said housing (18) results in an axial displacement of said compressive force regulating member (34) relative to said housing and also in a rotation of said annular member (42) relative to said compressive force regulating member (34) but does not result in a rotation of said annular member relative to said housing;

said cam path (20-1) including a raised land (20-3) axially projecting from said cam surface toward said proximal end of said bit holder, said clutch element (24) being engaged with said raised land to thereby transmit rotational torque to said bit holder (14) when said cam is caused to rotate, said clutch element being forced to ride over said raised land to thereby release said rotational torque when said rotational torque exceeds a predetermined value.

2. A power screwdriver as defined in claim 1, further comprising a clutch element retainer secured to the proximal end of said bit holder and axially spaced from said cam surface toward said bit holder, said clutch element including a roller rotatably carried by said clutch element retainer and held in contact with said cam path.

3. A power screwdriver as defined in claim 2, further comprising:

an axially movable follower interposed between said clutch element retainer and said proximal end of said housing and held in engagement with said thrust member; and a thrust bearing arranged between said follower and said clutch element retainer, said thrust member being operable to urge said clutch element against said cam surface through said thrust bearing and said follower.

4. A power screwdriver as defined in claim 1, wherein said raised land of said cam includes a front ramp and a rear ramp located rearwardly from said front ramp when said bit holder is rotated in a working direction, said front ramp having a relatively steep pitch and said rear ramp having a relatively gentle pitch, said power screwdriver further comprising a one-way clutch operable to transmit rotational torque from said drive shaft to said bit holder only when said bit holder is rotated in a direction opposite said working direction.

5. A power screwdriver as defined in claim 1, wherein said raised land of said cam includes a front ramp and a rear ramp located rearwardly from said front ramp when said bit holder is rotated in a working direction, said front ramp having a relatively steep pitch and said rear ramp having a relatively gentle pitch, said power screwdriver further comprising a one-way clutch operable to transmit rotational torque from said drive shaft to said bit holder only when said bit holder is rotated in a direction opposite said working direction.

6. A power screwdriver as defined in claim 1, wherein said raised land of said cam includes a front ramp and a rear ramp located rearwardly from said front ramp when said bit holder is rotated in a working direction, said front ramp having a relatively steep pitch and said rear ramp having a relatively gentle pitch, said power screwdriver further comprising a one-way clutch operable to transmit rotational torque from said drive shaft to said bit holder only when said bit holder is rotated in a direction opposite said working direction.

7. A power screwdriver as defined in claim 1, wherein said bit holder includes a through bore extending between said distal and proximal ends of said bit holder, wherein said shank of said screwdriver bit is inserted into said through bore through said distal end of said bit holder, said bit holder including a locking element engaged with said shank and said bit holder to lock said screwdriver bit against axial and rotational movements, and wherein said drive shaft is loosely inserted into said through bore through said proximal end of said bit holder, said power screwdriver further comprising a second compression spring disposed between said shank of said screwdriver bit and said drive shaft to urge said screwdriver bit in a forward direction.

8. A power screwdriver as defined in claim 7, further comprising a radial bearing assembly disposed adjacent to said through cavity of said housing to rotatably support said screwdriver bit.

* * * * *